US009630799B2

(12) United States Patent
Galea

(10) Patent No.: US 9,630,799 B2
(45) Date of Patent: Apr. 25, 2017

(54) METHOD AND APPARATUS FOR FABRICATING STRETCH FILM ROLLS

(71) Applicant: Anthony Galea, Markham (CA)

(72) Inventor: Anthony Galea, Markham (CA)

( * ) Notice: Subject to any disclaimer, the term of this patent is extended or adjusted under 35 U.S.C. 154(b) by 246 days.

(21) Appl. No.: 14/332,446

(22) Filed: Jul. 16, 2014

(65) Prior Publication Data

US 2016/0016747 A1 Jan. 21, 2016

(51) Int. Cl.
*B65H 20/28* (2006.01)
*B65H 45/22* (2006.01)

(52) U.S. Cl.
CPC ..... *B65H 45/22* (2013.01); *B65H 2301/3612* (2013.01); *B65H 2301/5124* (2013.01); *B65H 2301/51214* (2013.01); *B65H 2404/51* (2013.01); *B65H 2404/61* (2013.01); *B65H 2404/662* (2013.01); *B65H 2404/6942* (2013.01); *B65H 2701/1944* (2013.01)

(58) Field of Classification Search
CPC ..... B65H 20/28; B65H 18/10; B65H 37/06; B65H 2701/31; B65D 65/00
USPC ..... 264/285, 280
See application file for complete search history.

(56) References Cited

U.S. PATENT DOCUMENTS

| | | | | |
|---|---|---|---|---|
| 3,978,191 | A | 8/1976 | Allen et al. | |
| 4,905,451 | A | 3/1990 | Jaconelli et al. | |
| 5,047,002 | A * | 9/1991 | Zieke | B31B 19/90 156/66 |
| 5,520,872 | A | 5/1996 | Scherer | |
| 5,565,222 | A * | 10/1996 | Scherer | B65H 45/22 156/202 |
| 5,967,437 | A * | 10/1999 | Martin-Cocher | B65H 18/28 242/160.4 |
| 6,102,313 | A | 8/2000 | Salzsauler et al. | |
| 6,592,699 | B1 * | 7/2003 | Mehta | B29C 53/36 156/227 |
| 7,641,141 | B2 | 1/2010 | Pellengo Gatti | |
| 8,221,298 | B2 * | 7/2012 | Pirtle | B65H 18/10 493/356 |
| 8,286,904 | B2 | 10/2012 | Pellengo Gatti | |
| 8,292,212 | B2 | 10/2012 | Pellengo Gatti | |
| 9,162,403 | B2 * | 10/2015 | Helmy | B29D 7/01 |

* cited by examiner

*Primary Examiner* — Mark Halpern
(74) *Attorney, Agent, or Firm* — Renner Kenner Greive Bobak Taylor & Weber

(57) ABSTRACT

An apparatus for fabricating a stretch film roll comprises a device configured to fold a stretch film web to yield a folded stretch film web comprising at least one longitudinal band of increased thickness, with each band of increased thickness being spaced from the longitudinal edges of the folded stretch film web, and a driven winding shaft for winding the folded stretch film web.

15 Claims, 14 Drawing Sheets

METHOD AND APPARATUS FOR FABRICATING STRETCH FILM ROLLS

FIELD OF THE INVENTION

The present invention relates generally to stretch film and in particular, to a method and apparatus for fabricating stretch film rolls.

BACKGROUND OF THE INVENTION

Stretch film is widely used for wrapping and securing palletized loads for shipping. This is partly due to the fact that stretch film exhibits a "memory", or a tendency to shrink, upon stretching. For example, stretch film that is stretched by an amount of 10% will shrink nearly 10% of its stretched length. This "memory" assists in securing wrapped palletized articles together under compression.

Stretch film is fabricated in the form of stretch film rolls. Each stretch film roll may be used to manually wrap a palletized load, or may be loaded into an automated wrapping machine.

In some situations, the tensile strength of conventional stretch film may be insufficient to withstand tensile forces applied during wrapping, which can cause the stretch film to tear during wrapping.

Improvements are generally desired. It is therefore an object at least to provide a novel method and apparatus for fabricating stretch film rolls.

SUMMARY OF THE INVENTION

In one aspect, there is provided an apparatus for fabricating a stretch film roll, comprising: a device configured to fold a stretch film web to yield a folded stretch film web comprising at least one longitudinal band of increased thickness, each band of increased thickness being spaced from the longitudinal edges of the folded stretch film web; and a driven winding shaft for winding the folded stretch film web.

Each band of increased thickness may comprise a plurality of longitudinal folds. The at least one band of increased thickness may comprise a longitudinal band of wrinkled or bunched stretch film web. The at least one band of increased thickness may comprise a longitudinal pleat. The pleat may comprise at least two longitudinal folds.

The device may comprise: a member having at least one folding edge, and at least one guide, each guide configured to cooperate with a respective folding edge to form a respective longitudinal band of increased thickness. Each guide may be a generally conically-shaped tip. Each guide may be generally disc-shaped. Each generally disc-shaped guide may be configured to be rotatable. The member may be: a form defining at least one longitudinal channel, or at least one guide member. Each guide member may comprise a generally disc-shaped guide. Each generally disc-shaped guide may be configured to be rotatable.

The apparatus may further comprise at least one component configured to be oscillated for oscillating the folded stretch film web. The at least one component configured to be oscillated may be one or more of: at least one roller, at least one additional guide, the device, and the winding shaft. The at least one component may be configured to be oscillated along an axis that is generally orthogonal to a direction of travel of the folded stretch film web. The at least one component may be configured to be oscillated over either a fixed distance or a variable distance. The at least one component may be configured to be oscillated at either a fixed frequency or a variable frequency.

The winding shaft may support a core onto which the folded stretch film is wound. The winding shaft may be a coreless winding shaft onto which the folded stretch film is wound.

The stretch film web may be fabricated by the apparatus. The stretch film web may be provided to the apparatus as a supply of previously-fabricated stretch film web.

In another aspect, there is provided a method for fabricating a stretch film roll, comprising: providing a stretch film web; folding the stretch film web using a device to yield a folded stretch film web comprising at least one longitudinal band of increased thickness, each band of increased thickness being spaced from the longitudinal edges of the folded stretch film web; and winding the folded stretch film web.

The folding may comprise applying the stretch film web against at least one folding edge to form said at least one longitudinal band of increased thickness. The at least one longitudinal band of increased thickness may comprise a band of wrinkled or bunched stretch film web. The at least one longitudinal band of increased thickness may comprise a longitudinal pleat. Each pleat may comprise at least two longitudinal folds.

The method may further comprise oscillating the folded stretch film web prior to said winding. The oscillating may comprise oscillating one or more of the following along an axis that is generally orthogonal to a direction of travel of the folded stretch film web: at least one roller, at least one additional guide, the device, and the winding shaft.

The providing may comprise fabricating the stretch film web. The providing may comprise providing a supply of previously-fabricated stretch film web.

In another aspect, there is provided a method, comprising: providing a stretch film web; passing the stretch film web between a member and at least one guide, the member comprising at least one channel, the at least one guide cooperating with the at least one channel to yield a folded stretch film web comprising at least one longitudinal band of increased thickness.

The at least one guide may cooperate with the at least one channel to wrinkle or bunch the stretch film web. The at least one guide may cooperate with the at least one channel to form a pleat.

The providing may comprise fabricating the stretch film web. The providing may comprise providing a supply of previously-fabricated stretch film web.

BRIEF DESCRIPTION OF THE DRAWINGS

Embodiments will now be described more fully with reference to the accompanying drawings in which.

DETAILED DESCRIPTION OF THE EMBODIMENTS

Figure 1:
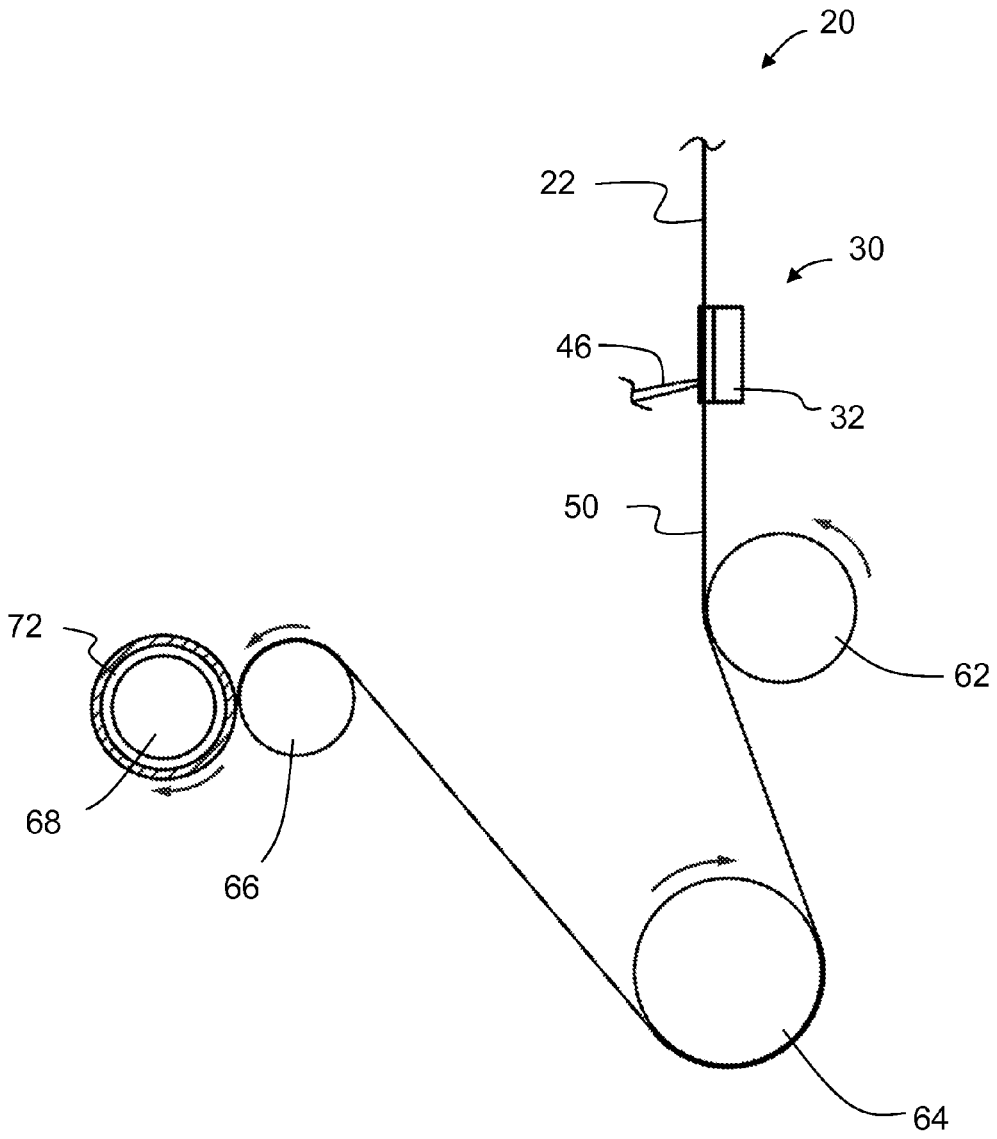
FIG. 1 is a side view of a portion of an apparatus for fabricating stretch film rolls, during use.

Turning now to FIG. 1, a portion of an apparatus for fabricating stretch film rolls is shown, and is generally indicated by reference numeral 20. Apparatus 20 comprises an extruder (not shown) that is configured to dispense a continuous sheet of plastic film onto a surface of a rotating cast roller (not shown) so as to form a stretch film web 22. Apparatus 20 also comprises a set of preliminary rollers (not shown) configured to receive the stretch film web 22 from the cast roller.

Figure 2:
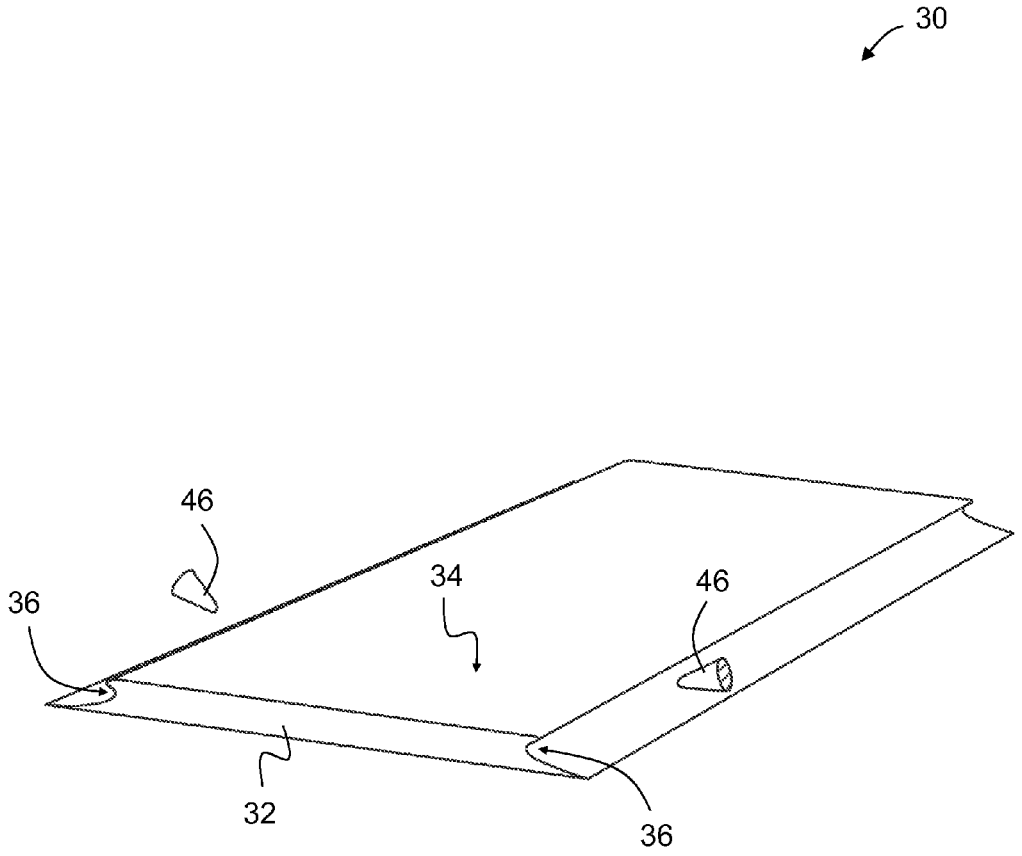
FIG. 2 is a perspective view of a folding device forming part of the apparatus of FIG. 1.
Figure 3:
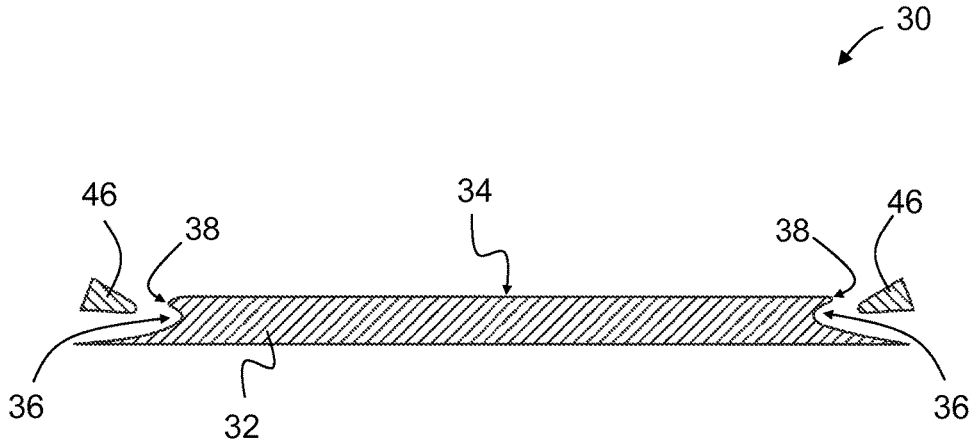
FIG. 3 is a sectional front view of the folding device of FIG. 2.
Figure 4:
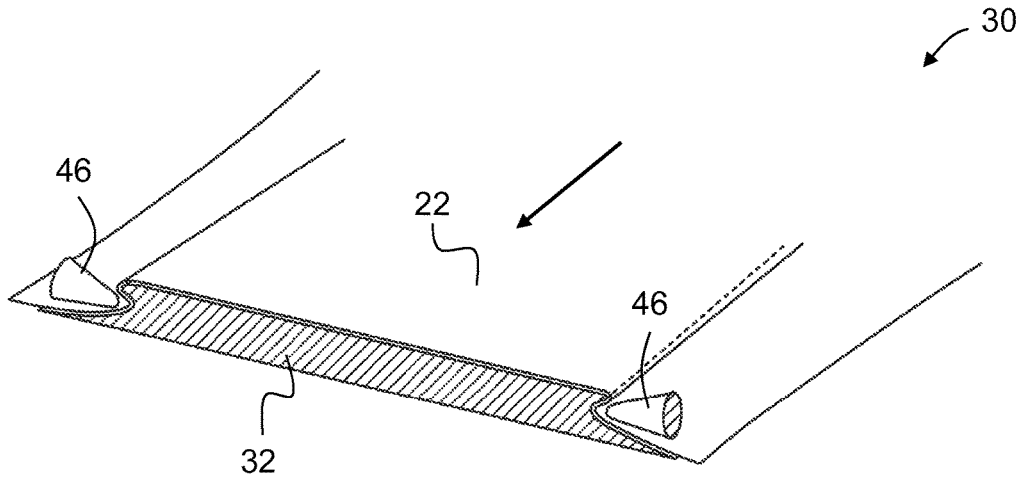
FIG. 4 is a sectional perspective view of the folding device of FIG. 2, during use.

Apparatus 20 further comprises a folding device 30 that is positioned downstream from the set of preliminary rollers, and that is configured to receive the stretch film web 22 from the set of preliminary rollers. The folding device 30 may be better seen in FIGS. 2 to 4. Folding device 30 comprises a form 32, which has a web-facing surface 34 over which the moving stretch film web 22 travels. In this embodiment, the form 32 also has two (2) channels 36, each of which extends along a longitudinal side of the form 32 in the direction of travel of the stretch film web 22. Each channel 36 is shaped so as to define a longitudinal folding edge 38 extending along a longitudinal edge of the planar surface 34.

Figure 5:
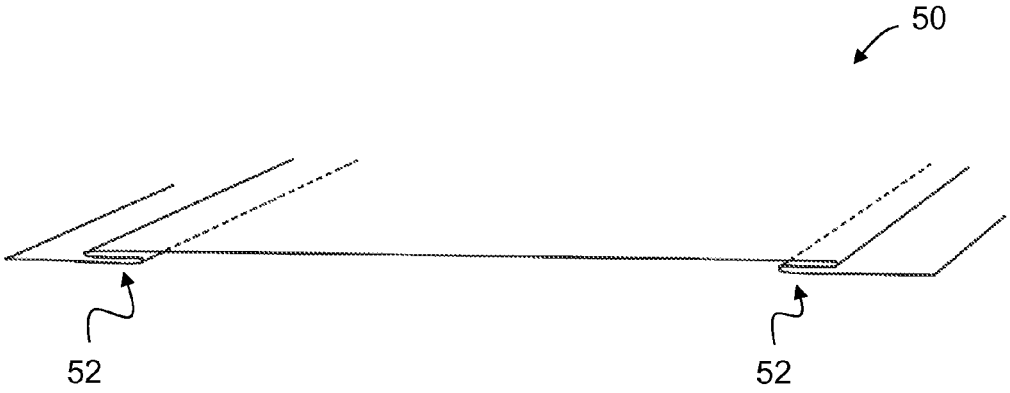
FIG. 5 is a sectional view of a portion of a folded stretch film web formed using the apparatus of FIG. 1.

The folding device 30 also comprises two (2) guides 46 positioned at the sides of the form 32. Each guide 46 is terminated by a rounded, generally conical tip that is sized to engage a respective channel 36, and each guide 46 is coupled to an adjustable positioning apparatus (not shown) for enabling the position of the guide 46 relative to the channel 36 to be adjusted as necessary. Each guide 46 is configured to cooperate with its respective folding edge 38 to form a pleat within the stretch film web. Specifically, each guide 46 is configured to direct a portion of the moving stretch film web 22 into the channel 36 and against the folding edge 38, which in turn causes a portion of the moving stretch film web 22 to fold onto itself downstream from the guide 46 and form a pleat. In this embodiment, the folding device 30 is configured to form a folded stretch film web 50 comprising two (2) pleats 52, with each pleat 52 comprising two (2) folds separated by a width of about 0.3 inches, as may be seen in FIG. 5. The folding device 30 is also configured such that each pleat 52 is spaced from the nearest longitudinal edge of the folded stretch film web 50 by at least a distance corresponding to the width of the pleat.

The apparatus 20 further comprises a first intermediate roller 62 that is configured to receive the folded stretch film web 50 from the folding device 30, and a second intermediate roller 64 that is configured to receive the folded stretch film web 50 from the first intermediate roller 62. In this embodiment, the first intermediate roller 62 and the second intermediate roller 64 are configured as idler rollers.

Additionally, in this embodiment, the second intermediate roller 64 is configured to be oscillated along an oscillation axis that is generally orthogonal to the direction of travel of the folded stretch film web 50, so as to cause the moving folded stretch film web 50 to also be oscillated. At least one assembly (not shown) is provided for oscillating the second intermediate roller 64 along the oscillation axis. The second intermediate roller 64 is oscillated at a fixed frequency and over a fixed distance along the oscillation axis. In this embodiment, the fixed frequency is a frequency in the range from about 0.1 cycles per minute to about 200 cycles per minute, and the fixed distance, and namely the distance travelled during one cycle, is a distance in the range from about 0.1 inches to about 4 inches.

Apparatus 20 further comprises a roller 66 that is configured to receive the oscillated, folded stretch film web 50 from the second intermediate roller 64. Apparatus 20 further comprises a winding shaft 68 positioned adjacent the roller 66 and supporting a core 72. The winding shaft 68, with the core 72 supported thereon, is configured to receive the oscillated folded stretch film web 50 from the roller 66 for winding the oscillated folded stretch film web 50 onto the core 72, so as to form a stretch film roll, and namely a roll of folded stretch film. An assembly (not shown) is provided for rotatably driving the winding shaft 68. The surface of the folded stretch film wound onto the core 72 is generally in contact with the surface of the roller 66, so as to prevent air entrapment between layers of the folded stretch film during winding. In this embodiment, the roller 66 is configured as an idler roller.

In use, the extruder dispenses a continuous sheet of plastic film onto the surface of the rotating cast roller to form the stretch film web 22, which is then received by the set of preliminary rollers. From the set of preliminary rollers, the stretch film web 22 travels downstream and is received by the folding device 30. As the stretch film web 22 travels through the folding device 30, it passes over the planar surface 34 of the form 32 and is directed into the channels 36 by the guides 38, so as to yield a folded stretch film web 50 comprising pleats 52.

Downstream from the folding device 30, the folded stretch film web 50 is received by the first intermediate roller 62, and in turn by the second intermediate roller 64. The second intermediate roller 64 is oscillated along the oscillation axis, which in turn causes the folded stretch film web 50 to be oscillated. From the second intermediate roller 64, the oscillated, folded stretch film web 50 is received by the roller 66, and in turn by the winding shaft 68 supporting the core 72, at which the oscillated, folded stretch film web 50 is wound onto the core 72 so as to form the roll of folded stretch film.

As will be appreciated, each pleat effectively triples the thickness of the stretch film, and thereby provides a band of reinforcement extending the length of the folded stretch film. As a result, the pleats advantageously increase the tensile strength of the folded stretch film and render the folded stretch film less prone to tearing during use, such as for example during wrapping of palletized loads for shipping, as compared to conventional stretch film.

Additionally, and as will be appreciated, the spacing of each pleat from the longitudinal edge of the folded stretch film advantageously allows the reinforcement provided by the pleats to be distributed across a greater portion of the width of the film.

Further, and as will appreciated, oscillation of the folded stretch film web prevents direct overlap of the pleats during winding, and thereby allows the shape of the roll of folded stretch film to be controlled. As will be understood, as a result of the oscillation, the roll of folded stretch film has a generally smooth contour, and without large bulges that would otherwise form due to direct overlap of the pleats in absence of oscillation. Additionally, prevention of direct overlap of the pleats during winding advantageously reduces or eliminates additional tension within the film caused by overlapping pleats, which would otherwise cause problems during unwinding of the film.

Figure 6:
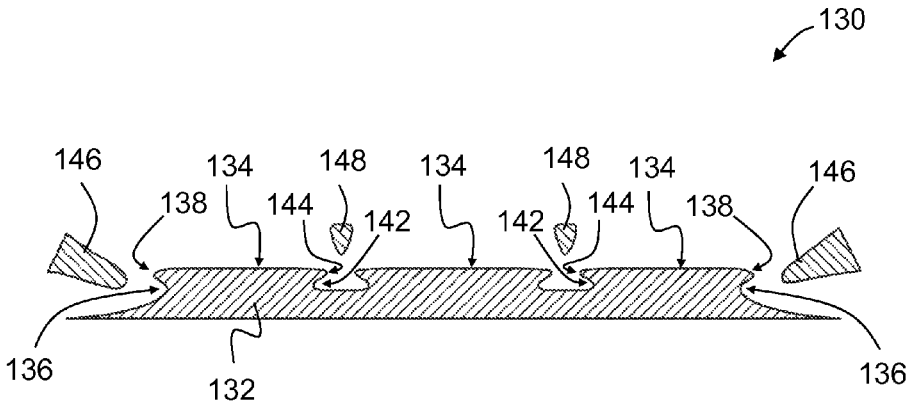
FIG. 6 is a sectional front view of another embodiment of a folding device forming part of the apparatus of FIG. 1.
Figure 7:
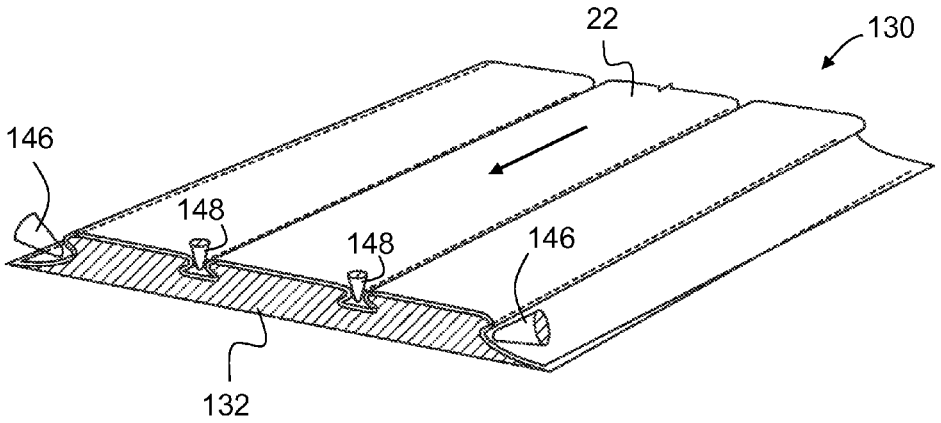
FIG. 7 is a sectional perspective view of the folding device of FIG. 6, during use.

Other configurations of the folding device are possible. For example, FIGS. 6 and 7 show another embodiment of a folding device, which is generally indicated by reference numeral 130. Folding device 130 is generally similar to folding device 30 described above and with reference to FIGS. 2 to 4, and comprises a form 132. The form 132 has a plurality of web-facing surfaces 134 over which the moving stretch film web 22 travels. In this embodiment, the form 132 also has four (4) channels, namely two (2) outer channels 136 and two (2) inner channels 142. Each outer channel 136 extends along a longitudinal side of the form 132 in the direction of travel of the stretch film web 22. Each outer channel 136 is shaped so as to define a longitudinal folding edge 138 extending along the longitudinal edge of a planar surface 134. Each inner channel 142 extends intermediate the longitudinal sides of the form 132 and in the direction of travel of the stretch film web 22. Each inner channel 142 is shaped so as to define a longitudinal folding edge 144 extending along a longitudinal edge of a planar surface 134.

Figure 8:
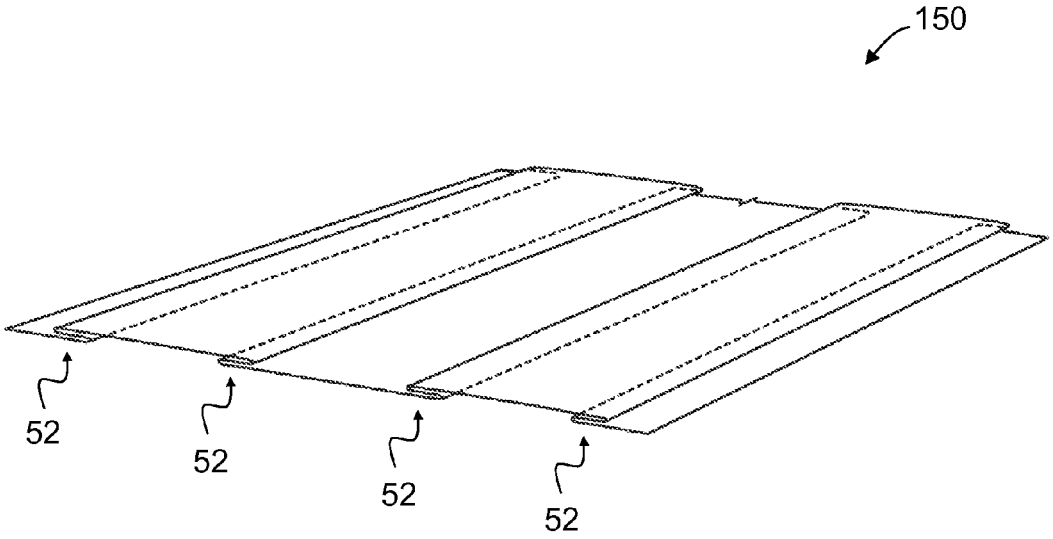
FIG. 8 is a sectional view of a portion of a folded stretch film web formed using the apparatus of FIG. 6.

The folding device 30 also comprises four (4) guides, namely two (2) outer guides 146 positioned at the sides of the form 132 and two (2) inner guides 148 positioned intermediate the sides of the form 132. Each guide 146 and 148 is terminated by a rounded, generally conical tip that is sized to engage a respective channel, and is coupled to an adjustable positioning apparatus (not shown) for enabling the position of the guide relative to the channel to be adjusted as necessary. Each outer guide 146 is configured to cooperate with its respective folding edge 138 to form a pleat within the stretch film web. Specifically, each outer guide 146 is configured to direct a portion of the moving stretch film web 22 into the outer channel 136 and against the folding edge 138, which in turn causes a portion of the moving stretch film web 22 to fold onto itself downstream from the guide 146 and form a pleat. Similarly, each inner guide 148 is configured to cooperate with a respective folding edge 144 to form a pleat within the stretch film web. Specifically, each inner guide 148 is configured to direct a portion of the moving stretch film web 22 into the inner channel 142 and against the folding edge 144, so as to cause a portion of the moving stretch film web 22 to fold onto itself downstream from the guide 148 and form a pleat. In this embodiment, the folding device 130 is configured to form a folded stretch film web 150 comprising four (4) pleats 52, with each pleat 52 comprising two (2) folds separated by a width of about 0.3 inches, as may be seen in FIG. 8. The folding device 130 is also configured such that each pleat 52 is spaced from the nearest longitudinal edge of the folded stretch film web 150 by at least a distance corresponding to the width of the pleat.

Figure 9:
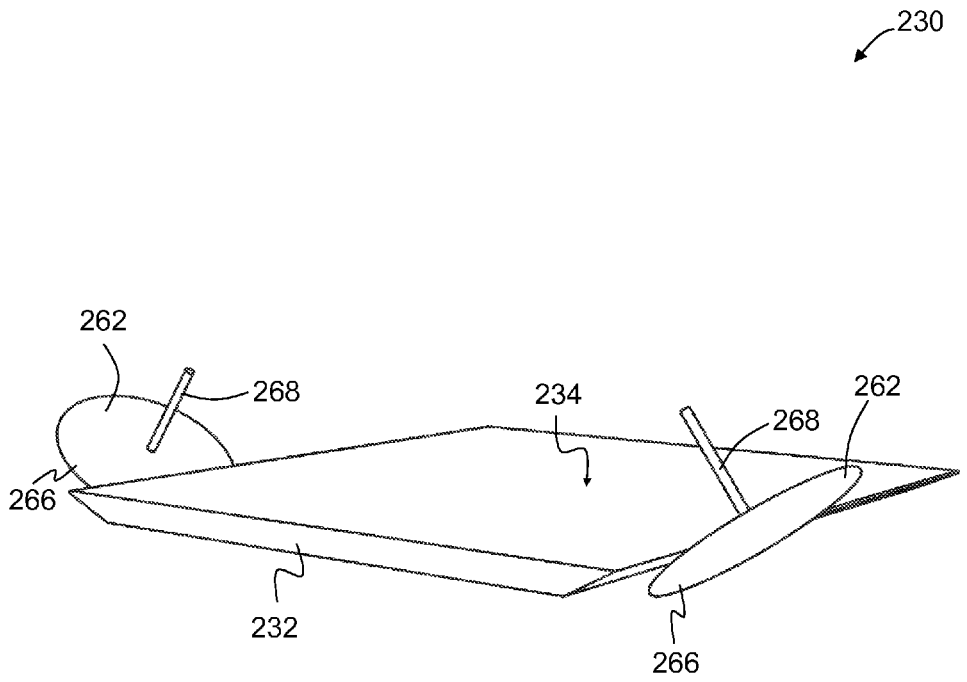
FIG. 9 is a perspective view of another embodiment of a folding device forming part of the apparatus of FIG. 1.
Figure 10:
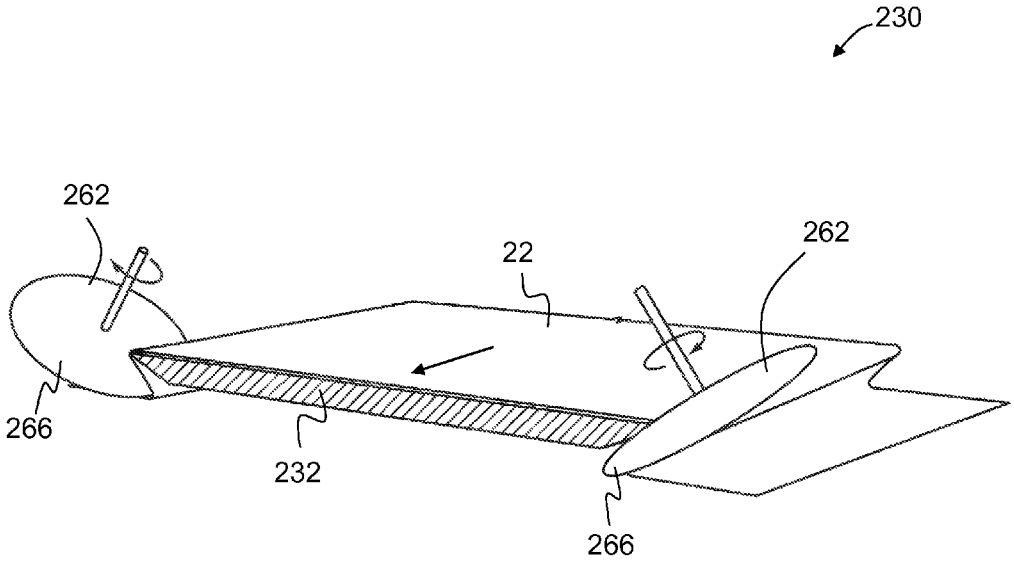
FIG. 10 is a sectional perspective view of the folding device of FIG. 9, during use.
Figure 11:
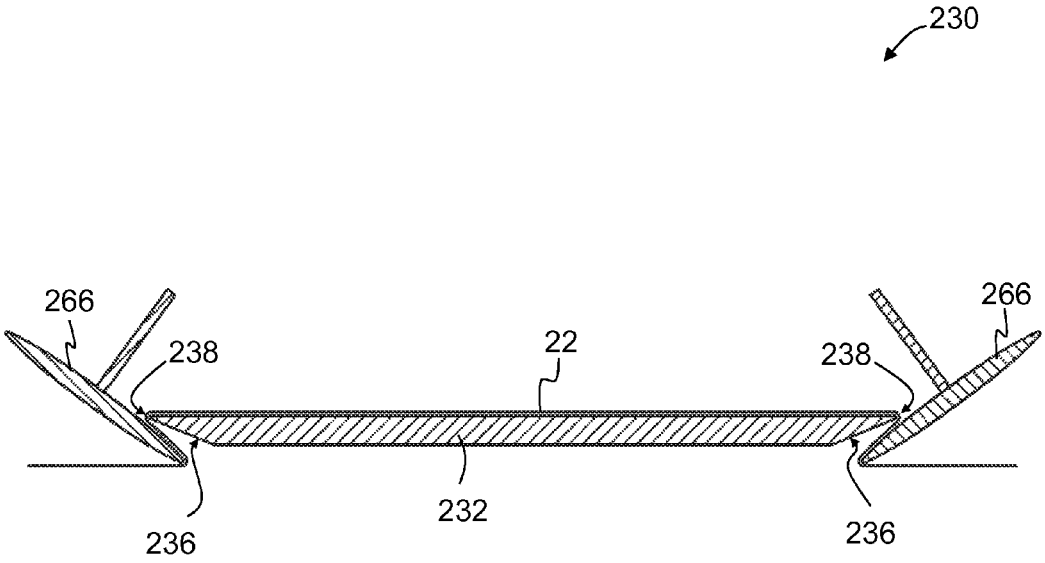
FIG. 11 is a sectional front view of the folding device of FIG. 9, during use.

FIGS. 9 to 11 show another embodiment of a folding device, which is generally indicated by reference numeral 230. Folding device 230 is generally similar to folding device 30 described above and with reference to FIGS. 2 to 4, and comprises a form 232 that has a web-facing surface 234 over which the moving stretch film web 22 travels. In this embodiment, the form 232 also has two inclined, longitudinal side surfaces 236 extending the length of the form 232 in the direction of travel of the stretch film web 22. Each longitudinal side surface 236 defines a longitudinal folding edge 238 extending along the longitudinal edge of the planar surface 234.

The folding device 230 also comprises two (2) guide members 262, with each guide member 262 positioned adjacent a longitudinal side surface 236 of the form 232. Each guide member 262 comprises a generally disc-shaped guide 266 mounted to an axle 268, and is coupled to an adjustable positioning apparatus (not shown) for enabling the position of the guide 266 relative to the form 232 to be adjusted as necessary. In this embodiment, each guide member 262 is configured to rotate freely about its axle 268, such that each guide 266 is rotatable.

Each guide 266 is configured to cooperate with its respective folding edge 238 to form a pleat within the stretch film web 22. Specifically, each guide 266 is configured to direct a portion of the moving stretch film web 22 toward the longitudinal side surface 236 and against the folding edge 238, so as to cause a portion of the moving stretch film web 22 to fold onto itself downstream from the guide 266 and form a pleat. In this embodiment, the folding device 230 is configured to form the folded stretch film web 50 comprising two (2) pleats 52, with each pleat 52 comprising two (2) folds separated by a width of about 0.3 inches, as described above and with reference to FIG. 5. The folding device 230 is also configured such that each pleat 52 is spaced from the nearest longitudinal edge of the folded stretch film web 50 by at least a distance corresponding to the width of the pleat.

In other embodiments, one or more of the guide members may alternatively be fixed, and not be configured to rotate freely. In one such embodiment, the guide(s) of the fixed guide member(s) may alternatively have a shape other than generally disc-shaped. For example, in one such embodiment, the guide(s) of the fixed guide member(s) may alternatively be shaped as half-disc(s). It will be understood by those of skill in the art that other guide shapes may alternatively be used.

Figure 12:
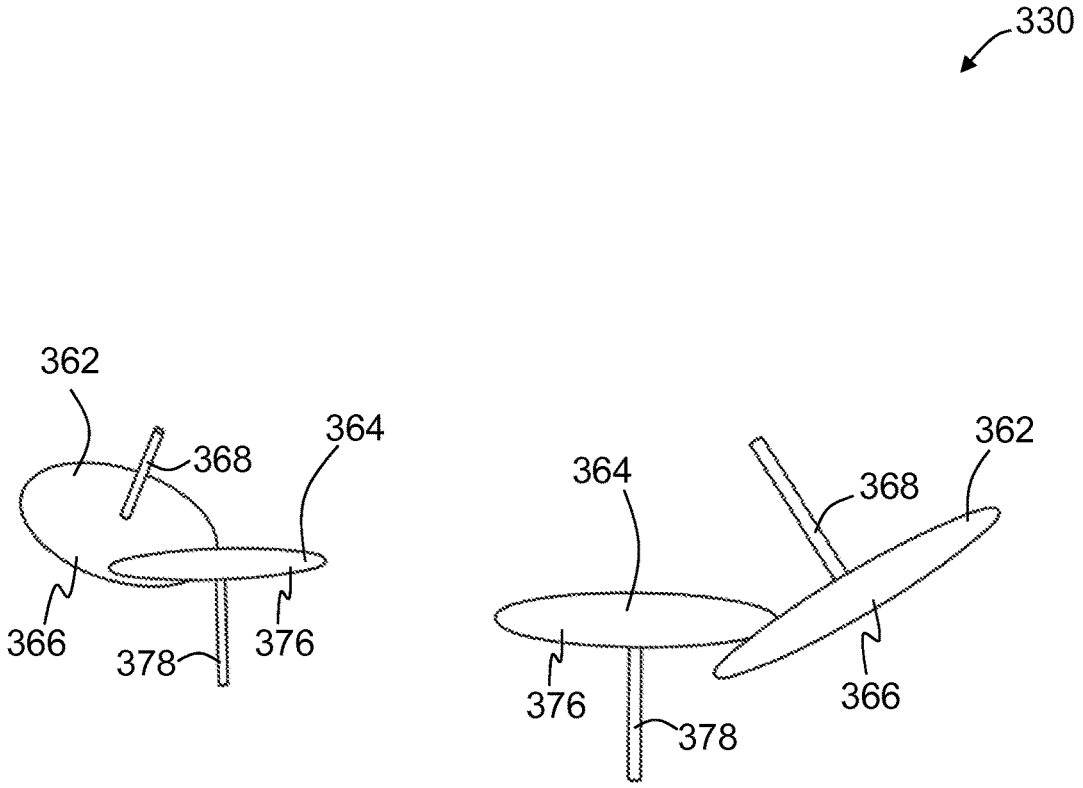
FIG. 12 is a perspective view of another embodiment of a folding device forming part of the apparatus of FIG. 1.
Figure 13:
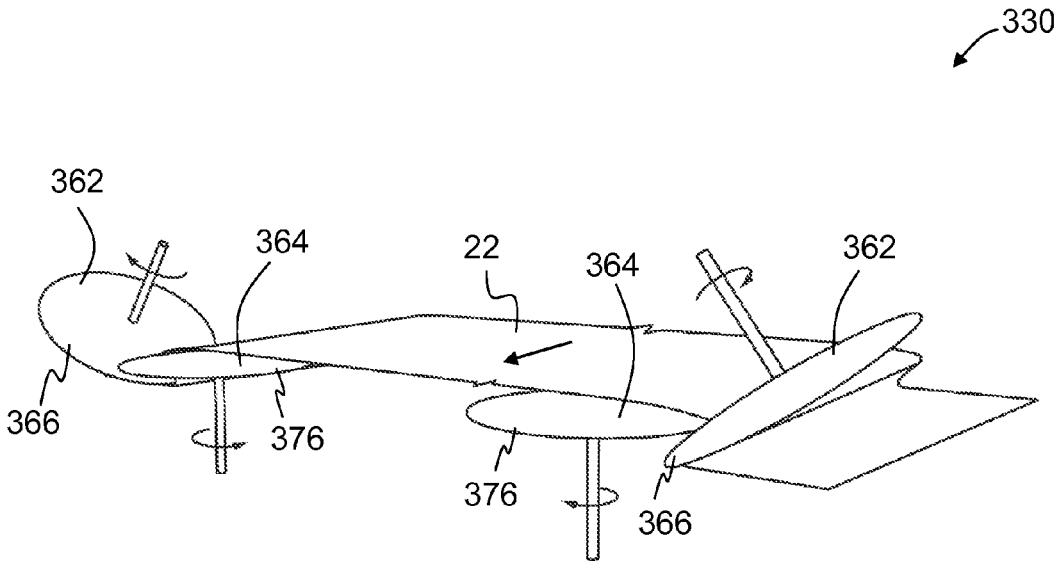
FIG. 13 is a perspective view of the folding device of FIG. 12, during use.
Figure 14:
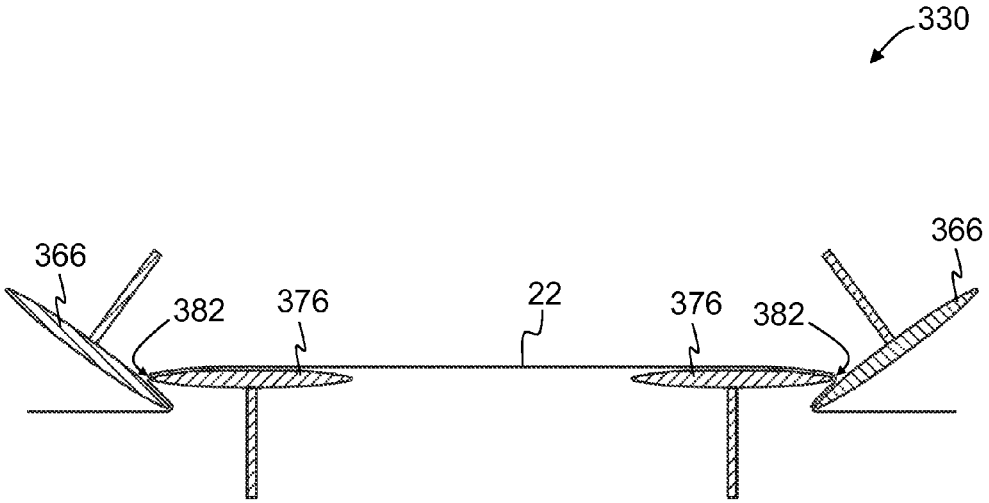
FIG. 14 is a sectional front view of the folding device of FIG. 12, during use.

FIGS. 12 to 14 show another embodiment of a folding device, which is generally indicated by reference numeral 330. Folding device 330 comprises a plurality of guide members arranged in a spaced relationship. Specifically, the folding device 330 comprises a pair of first guide members 362 and a pair of second guide members 364. Each first guide member 362 comprises a generally disc-shaped guide 366 mounted to an axle 368. Each second guide member 364 is similar to the first guide member 362, and comprises a generally disc-shaped guide 376 mounted to an axle 378. Each first guide member 362 is coupled to an adjustable positioning apparatus (not shown) for enabling the position of the guide 366 relative to the guide 376 of the second guide member 364 to be adjusted as necessary. In this embodiment, each guide member 362 and 364 is configured to rotate freely about its axle 368 and 378, respectively, such that each guide 366 and 376 is rotatable.

Each first guide member 362 is configured to cooperate with a respective second guide member 364 to form a pleat within the stretch film web 22. Specifically, each guide 366 is configured to direct a portion of the moving stretch film web 22 against a folding edge defined by the proximal edge 382 of each guide 376, so as to cause a portion of the moving stretch film web 22 to fold onto itself downstream of the guides 366 and 376 (not shown) and form a pleat. In this embodiment, the folding device 330 is configured to form the folded stretch film web 50 comprising two (2) pleats 52, with each pleat 52 comprising two (2) folds separated by a width of about 0.3 inches, as described above and with reference to FIG. 5. The folding device 230 is also configured such that each pleat 52 is spaced from the nearest longitudinal edge of the folded stretch film web 50 by at least a distance corresponding to the width of the pleat.

In other embodiments, one or more of the first guide members and the second guide members may alternatively be fixed, and not be configured to rotate freely. In such embodiments, the guide(s) of the fixed guide member(s) may alternatively have a shape other than generally disc-shaped. For example, in one such embodiment, the guide(s) of the fixed guide member(s) may alternatively be shaped as half-disc(s). It will be understood by those of skill in the art that other guide shapes may alternatively be used.

Although in the embodiments described above, the folding device is configured to form a folded stretch film web comprising either two (2) or four (4) pleats, in other embodiments, the folding device may alternatively be configured to form a folded stretch film web comprising a different number of pleats, such as one (1) pleat, three (3) pleats, or more than four (4) pleats. It will be understood that in such alternative embodiments, the folding device would be suitably configured and have a suitable number of guide(s) to form the corresponding number of pleat(s).

Although in the embodiments described above, each pleat comprises two (2) folds separated by a width of about 0.3 inches, in other embodiments, one or more pleats may alternatively comprise two (2) folds separated by a width in the range from about 0.0625 inches to about 4 inches. Still greater widths may be used.

Although in embodiments described above, each pleat is spaced from the nearest longitudinal edge of the folded stretch film web by at least a distance corresponding to the width of the pleat, in other embodiments, each pleat may alternatively be spaced from the nearest longitudinal edge of the folded stretch film web by a distance of about 0.0625 inches or more.

The folding devices of the embodiments described above may alternatively be used to yield stretch film rolls comprising one or more longitudinal bands of wrinkled or bunched film. For example, during use of the folding device 130 described above and with reference to FIGS. 6 and 7, different operating conditions may result in the formation of one or more bands of wrinkled or bunched film instead of pleats.

Figure 15:
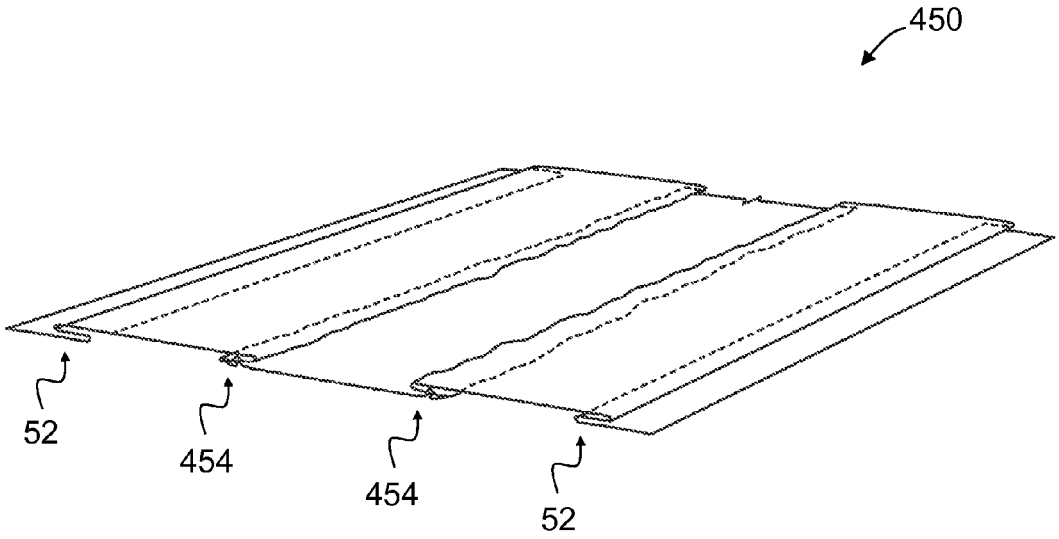
FIG. 15 is a sectional view of a portion of another embodiment of a folded stretch film web formed using the apparatus of FIG. 6.

For example, in one embodiment, under different operating conditions, each inner guide 148 of the folding device 130 may be configured to direct a portion of the moving stretch film web 22 into the inner channel 142, so as to cause a portion of the moving stretch film web 22 to wrinkle or bunch downstream from the guide 148 to form a longitudinal band of wrinkled or bunched stretch film web. In this embodiment, the folding device 130 is configured to form a folded stretch film web 450 comprising two (2) pleats 52, with each pleat 52 comprising two (2) folds separated by a width of about 0.3 inches, and two (2) longitudinal bands 454 of wrinkled or bunched stretch film web, as may be seen in FIG. 15. Each longitudinal band 454 comprises a wrinkled or bunched portion of stretch film web that has increased thickness and that comprises a plurality of longitudinal folds. Each longitudinal band 454 is spaced from the nearest longitudinal edge of the folded stretch film web 450 by at least a distance corresponding to the width of the longitudinal band. In this embodiment, each longitudinal band 454 has a width of about 0.3 inches.

The folded stretch film web 450 then travels through the apparatus 20 downstream from the folding device 130, in generally the same manner as described above for folded stretch film web 50. For example, the second intermediate roller 64, which is configured to be oscillated along the oscillation axis that is generally orthogonal to the direction of travel of the folded stretch film web 450, causes the moving folded stretch film web 450 to also be oscillated. Also, the winding shaft 68, with the core 72 supported thereon, is configured to receive the oscillated folded stretch film web 450 from the roller 66 for winding the oscillated folded stretch film web 450 onto the core 72, so as to form a stretch film roll, and namely a roll of folded stretch film.

As will be appreciated, each longitudinal band of wrinkled or bunched stretch film increases the thickness of the stretch film, and thereby provides a band of reinforcement extending the length of the folded stretch film. As a result, the longitudinal band(s) of wrinkled or bunched stretch film advantageously increase(s) the tensile strength of the stretch film and render(s) the folded stretch film less prone to tearing during use, such as for example during wrapping of palletized loads for shipping, as compared to conventional stretch film.

Additionally, and as will be appreciated, the spacing of each longitudinal band of wrinkled or bunched stretch film from the longitudinal edge of the folded stretch film advantageously allows the reinforcement to be distributed across a greater portion of the width of the film.

Although in the embodiment described above, each longitudinal band of wrinkled or bunched stretch film web has a width of about 0.3 inches, in other embodiments, at least one longitudinal band may alternatively have a width in the range from about 0.0625 inches to about 4 inches. Still greater widths may be used.

Although in embodiments described above, each longitudinal band of wrinkled or bunched stretch film web is spaced from the nearest longitudinal edge of the folded stretch film web by at least a distance corresponding to the width of the longitudinal band, in other embodiments, at least one longitudinal band may alternatively be spaced from the nearest longitudinal edge of the folded stretch film web by a distance of about 0.0625 inches or more.

It will be appreciated that, in other embodiments, and during use of any of the folding devices described above, different operating conditions may result in the formation of one or more bands of wrinkled or bunched film instead of one or more pleats.

The apparatus may have other configurations. For example, although in the embodiment described above, the second intermediate roller is configured to be oscillated along an oscillation axis, in other embodiments, one or more of the following may alternatively be configured to each be oscillated along a respective oscillation axis: the folding device; the first intermediate roller; the second intermediate roller; the roller adjacent the winding shaft; and the winding shaft. For example, in one such alternative embodiment, the winding shaft may be configured to be oscillated along an oscillation axis, while the other rollers and components of the apparatus may be configured to not be oscillated. In still other embodiments, the apparatus may alternatively comprise one or more additional guides separate from the folding device that are configured to be oscillated along a respective oscillation axis for oscillating the folded stretch film web.

Although in the embodiment described above, the second intermediate roller is oscillated over a fixed distance along the oscillation axis, in other embodiments, the second intermediate roller may alternatively be oscillated over a variable distance along the oscillation axis, such as for example, a periodically variable distance or a random distance.

Although in the embodiment described above, the second intermediate roller is oscillated over a fixed distance along the oscillation axis, in other embodiments, the second intermediate roller may alternatively be oscillated over a variable distance along the oscillation axis, such as for example, a periodically variable distance or a random distance.

Although in the embodiment described above, the fixed frequency is a frequency in the range from about 0.1 cycles per minute to about 200 cycles per minute, in other embodiments, the fixed frequency may alternatively be a frequency that is greater than 200 cycles per minute.

Although in the embodiment described above, the fixed distance is a distance in the range from about 0.1 inches to about 4 inches, in other embodiments, the fixed frequency may alternatively be a distance that is greater than 4 inches.

Although in the embodiment described above, the oscillation axis of the second intermediate roller is generally orthogonal to the direction of travel of the folded stretch film web, in other embodiments, the oscillation axis of the cutting station and the cutting blades may alternatively be non-orthogonal to the direction of travel of the folded stretch film web.

Although in the embodiment described above, the first intermediate roller and the second intermediate roller are configured as idler rollers, in other embodiments, one or both of the first intermediate roller and the second intermediate roller may alternatively be configured as a driven roller.

Although in the embodiment described above, the apparatus comprises a first intermediate roller and a second intermediate roller, in other embodiments, the apparatus may alternatively comprise fewer or more intermediate rollers. In one embodiment, the apparatus may alternatively comprise no intermediate rollers.

Although in the embodiment described above, the apparatus comprises a winding shaft supporting a core, in other embodiments, the apparatus may alternatively comprise a coreless winding shaft that does not support a core, onto which the oscillated folded stretch film web is wound so as form a coreless roll of folded stretch film.

Although in the embodiment described above, the roller adjacent the winding shaft is configured as an idler roller, in other embodiments, the roller adjacent the winding shaft may alternatively be configured as a driven roller. In one such embodiment, the surface speed of the driven roller may be matched to the surface speed of the wound film on the winding shaft using automated or computer-controlled speed matching. In another such embodiment, there may be no assembly provided for rotatably driving the winding shaft, and the winding shaft may alternatively be driven through contact with the surface of the driven roller.

Those skilled in the art will appreciate that the apparatus is not limited to the components described above. For example, in other embodiments, one or more of the first intermediate roller, the second intermediate roller, and the roller adjacent the winding shaft, may alternatively not be provided.

Other apparatus configurations are possible. For example, although in the embodiment described above, the apparatus comprises an extruder and a rotating cast roller for forming the stretch film web, in other embodiments, the apparatus may alternatively not comprise an extruder and a cast roller for forming the stretch film web, but may alternatively comprise a supply (e.g. a spool, a roll, etc.) of previously-fabricated stretch film web, and provisions for feeding the stretch film web from the supply either directly or indirectly to the folding device. It will be understood that such a configuration would provide an "off-line" or "secondary" apparatus for fabricating the stretch film roll, and namely the roll of folded stretch film. Those skilled in the art will recognize that such previously-fabricated stretch film webs may otherwise typically be used for other "off-line" or "secondary" processes such as, for example, one or more of: conventional rewinding, slitting, pre-stretching, and edge folding/rolling.

Figure 16:
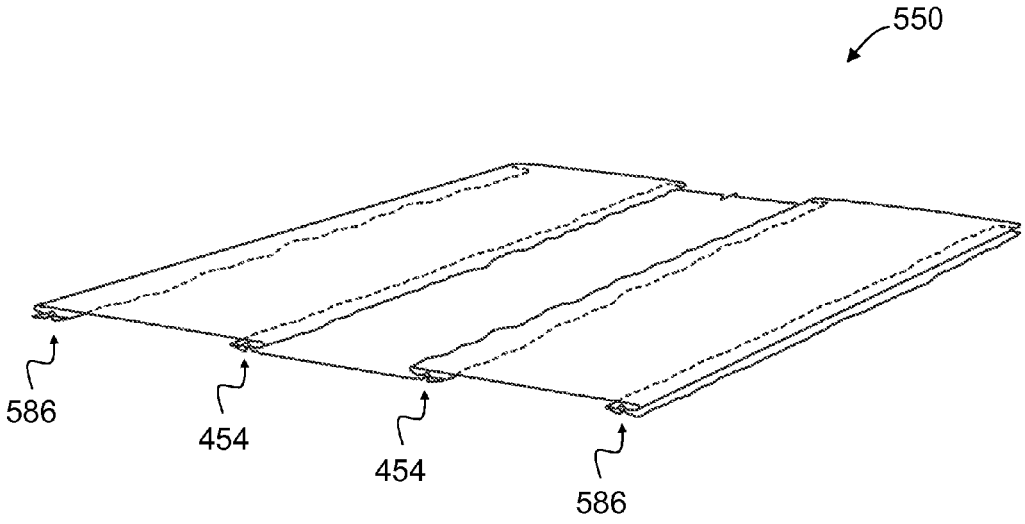
FIG. 16 is a sectional view of a portion of still another embodiment of a folded stretch film web.

For example, FIG. 16 shows another embodiment of a folded stretch film web formed using another embodiment of an apparatus (not shown), and which is generally indicated by reference numeral 550. Folded stretch film web 550 is formed using a secondary apparatus (not shown) for fabricating a stretch film roll. In this embodiment, the secondary apparatus comprises a supply (e.g. a spool, a roll, etc.) of previously-fabricated stretch film web, and provisions (not shown) for feeding the stretch film web from the supply (not shown) to the downstream portion of the secondary apparatus. The secondary apparatus also comprises an edge rolling device (not shown) configured to roll the edges of the stretch film web, so as to form edge rolls 586. Each edge roll 586 comprises a rolled, generally wrinkled or bunched portion of stretch film web extending the length of an edge of the stretch film web. Edge rolling devices configured to form edge rolls have been previously described, for example, in U.S. Pat. No. 5,531,393 to Salzsauler et al.

The secondary apparatus further comprises a folding device (not shown) positioned downstream from the edge rolling device. The folding device is similar to folding device 130 described above and with reference to FIGS. 5 to 7, but comprises a form (not shown) having only two (2) inner channels (not shown). The folding device of this embodiment also comprises two (2) inner guides (not shown), each sized to engage a respective channel. In this embodiment, the folding device is configured to form a folded stretch film web 550 comprising two (2) longitudinal bands 454 of wrinkled or bunched stretch film web, in a similar manner as longitudinal bands 454 described above and with reference to FIG. 15. Each longitudinal band 454 comprises a wrinkled or bunched portion of stretch film web that has increased thickness and that comprises a plurality of longitudinal folds. Each longitudinal band 454 is spaced from the nearest longitudinal edge of the folded stretch film web. Further, each longitudinal band 454 is spaced from the nearest edge roll 586 of the folded stretch film web 450 by at least a distance corresponding to the width of the longitudinal band. In this embodiment, each longitudinal band 454 has a width of about 0.3 inches.

In this embodiment, the secondary apparatus further comprises one or more oscillating members (not shown) configured to yield an oscillated, folded stretch film web 550, and a winding shaft (not shown) for winding the oscillated folded stretch film web 550 to form a stretch film roll, and namely a roll of folded stretch film comprising two (2) longitudinal bands 454 of wrinkled or bunched stretch film web and two (2) edge rolls 586, as shown in FIG. 16.

Although in the embodiment described above, the edge rolling device is positioned upstream from the folding device, in other embodiments, the edge rolling device may alternatively be positioned downstream from the folding device.

Although in the embodiment described above, the secondary apparatus also comprises an edge rolling device configured to roll the edges of the stretch film web, in other embodiments, the secondary apparatus may alternatively comprise an edge folding device configured to fold the edges of the stretch film web.

Although in the embodiment described above, each longitudinal band of wrinkled or bunched stretch film web has a width of about 0.3 inches, in other embodiments, at least one longitudinal band may alternatively have a width in the range from about 0.0625 inches to about 4 inches. Still greater widths may be used.

Although in embodiments described above, each longitudinal band of wrinkled or bunched stretch film web is spaced from the nearest edge roll of the folded stretch film web by at least a distance corresponding to the width of the longitudinal band, in other embodiments, at least one longitudinal band may alternatively be spaced from the nearest edge roll of the folded stretch film web by a distance of about 0.0625 inches or more.

In other embodiments, different operating conditions may result in the formation of one or more pleats instead of one or more of longitudinal bands of wrinkled or bunched stretch film web.

It will be appreciated that the stretch film roll, and namely the roll of folded stretch film in accordance with the above-described embodiments, may therefore comprise: one or more pleats and/or one or more longitudinal bands of wrinkled or bunched stretch film web, in any combination, and may optionally comprise edge rolls or edge folds, and may be fabricated using an "offline" or "secondary" apparatus, or using a "non-offline" or "non-secondary" apparatus.

Although embodiments have been described above with reference to the accompanying drawings, those of skill in the art will appreciate that variations and modifications may be made without departing from the scope thereof as defined by the appended claims.

What is claimed is:

1. An apparatus for fabricating a stretch film roll, comprising:

a device configured to fold a stretch film web to yield a folded stretch film web comprising at least one longitudinal band of increased thickness, each band of increased thickness being spaced from the longitudinal edges of the folded stretch film web;

at least one component configured to be oscillated for oscillating the folded stretch film web; and a driven winding shaft for winding the folded stretch film web into a roll, wherein the at least one component configured to be oscillated is one or more of: at least one roller, at least one additional guide, the device, and the winding shaft.

2. The apparatus of claim 1, wherein each band of increased thickness comprises a plurality of longitudinal folds.

3. The apparatus of claim 1, wherein the at least one band of increased thickness comprises a longitudinal band of wrinkled or bunched stretch film web.

4. The apparatus of claim 1, wherein the at least one band of increased thickness comprises a longitudinal pleat.

5. The apparatus of claim 4, wherein the pleat comprises at least two longitudinal folds.

6. The apparatus of claim 1, wherein the device comprises:

a member having at least one folding edge, and at least one guide, each guide configured to cooperate with a respective folding edge to form a respective longitudinal band of increased thickness.

7. The apparatus of claim 6, wherein each guide is a generally conically-shaped tip.

8. The apparatus of claim 6, wherein each guide is generally disc-shaped.

9. The apparatus of claim 8, wherein each generally disc-shaped guide is configured to be rotatable.

10. The apparatus of claim 6, wherein the member is:

a form defining at least one longitudinal channel, or at least one guide member.

11. The apparatus of claim 1, wherein the at least one component is configured to be oscillated along an axis that is generally orthogonal to a direction of travel of the folded stretch film web.

12. The apparatus of claim 1, wherein the winding shaft supports a core onto which the folded stretch film is wound.

13. The apparatus of claim 1, wherein the winding shaft is a coreless winding shaft onto which the folded stretch film is wound.

14. The apparatus of claim 1, wherein the stretch film web is fabricated by the apparatus.

15. The apparatus of claim 1, wherein stretch film web is provided to the apparatus as a supply of previously-fabricated stretch film web.

* * * * *